United States Patent [19]

McMahon

[11] Patent Number: 5,014,498

[45] Date of Patent: May 14, 1991

[54] WEB CONTROL MEANS AND METHOD FOR BAG MAKING MACHINE

[75] Inventor: Michael J. McMahon, Palatine, Ill.

[73] Assignee: Illinois Tool Works, Glenview, Ill.

[21] Appl. No.: 464,018

[22] Filed: Jan. 12, 1990

[51] Int. Cl.[5] ..... B65B 9/08; B65B 41/16; B31B 1/84

[52] U.S. Cl. ..... 53/451; 53/389.1; 53/551; 226/108; 493/213

[58] Field of Search ..... 53/128, 133, 389, 410, 53/412, 450, 451, 550, 551, 553, 554, 552, 64; 493/213, 214, 390, 923; 226/108, 113, 114

[56] References Cited

U.S. PATENT DOCUMENTS

| | | | |
|---|---|---|---|
| 2,955,398 | 10/1960 | Dreeben | 53/551 |
| 3,721,376 | 3/1973 | Christian et al. | 226/113 X |
| 3,727,820 | 4/1973 | Braun | 226/113 |
| 3,743,154 | 7/1973 | Brewitz | 226/113 |
| 3,890,547 | 6/1975 | Keck | 226/113 X |
| 4,343,421 | 8/1982 | Assmann et al. | 226/113 |
| 4,790,126 | 12/1988 | Boeckmann | 226/197 X |
| 4,798,353 | 1/1989 | Peugh | 226/114 X |

*Primary Examiner*—Robert L. Spruill
*Assistant Examiner*—Beth Bianca
*Attorney, Agent, or Firm*—Hill, Van Santen, Steadman & Simpson

[57] ABSTRACT

An apparatus and method for making and filling bags from plastic film, wrapping an endless supply about a forming and filling tube where the supply has a plastic zipper profile extending intermediate the edges of the film material, controlling the feed of film over a sharp edge of a former so that a tension free slack is maintained in the film to eliminate the possibility of distortion or damage to the small rib and groove interlocking zipper profiles on the film.

22 Claims, 4 Drawing Sheets

WEB CONTROL MEANS AND METHOD FOR BAG MAKING MACHINE

BACKGROUND OF THE INVENTION

The present invention relates to improvements in form, fill and seal machines, and more particularly to a bag forming machine wherein an endless supply of plastic film with a zipper intermediate the edges is fed over a forming and filling tube and the edges sealed to form a tubular bag.

In a form, fill and seal operation, an endless continuous supply of film is brought forwardly and is shaped and wrapped around a filling and forming tube. The shaped film has its edges brought together and joined to form a tubular container. Contents are dropped through the filling tube into the container and cross-seals are formed to provide lengths of bags which are cut apart. In one method of forming bags in a form, fill operation, the film is provided with reclosable rib and groove zipper profiles extending longitudinally along the film parallel to the forming axis of the film. In the formation of the film into tubular form, the profiles can be joined as the bag is formed. It has been discovered that a stable operation can be accomplished by utilizing film where the profiles are already joined and are located intermediate the edges of the film. In this operation, the edges of the film are brought together to form a bottom seam for the bag. An example of a bag formation where the profiles are brought together is shown in Tilman U.S. Pat. No. 4,355,494. In U.S. Pat. No. 4,617,683, to Christoff and Ausnit, the formation of bags is illustrated where the raw edges of the film are joined, and in the present arrangement, a formation procedure such as that shown in the Christoff et al patent is employed with film being supplied where the interlocked profiles are located intermediate the edges of the film.

The packaging of products for retail sale and consumption has developed gradually over the years in order to enhance the ease with which the consumer can open the packaging in order to gain access thereto for use or consumption of the food product therein. In the form, fill and seal operation described above, such reclosable packages can be developed at relatively high manufacturing speed using an endless supply of film where the profiles are already extruded as part of the film and previously interlocked. In such packaging and package making, the containers are manufactured with the interlocking rib and groove profiles accurately and critically made so that they will protect the contents, such as foodstuffs, therein and yet be readily opened and reclosed. The profiles are made to be very relatively minute, and as such with accurate manufacturing tolerances, the shape and size of the profile must be accurately maintained and not distorted either in manufacture or in storage. It is a desirable attribute of such packaging that the bags be closed securely in an airtight manner to maintain freshness of a food product remaining within the package. The food products may be of varying types such as that which are packaged and stored within a box or carton which has the bag as an internal liner or pouch to contain dry cereal products. Other forms of packages or pouches can be made which are handled, stored and sold without a protective carton surrounding them.

The success of this type of packaging, which affords the customer with a reopenable package, relates to having mating flexible closure strips which interlock and do not afford leakage. Also, the flexible closure strips must be capable of being handled and reclosed easily. The success of such closures depends to a great extent upon avoiding deformities in the profiles while the material is being handled and particularly while it is being fed forwardly onto the forming machine and being completed by having the bottom seam and side seams formed.

In the formation of these pouches, the film is fed forwardly at production manufacturing speeds over the forming and filling tube. Acceptable manufacturing procedures require that the film be advanced intermittently with the advance stopped while the bottom seam and cross-seams are being formed. After the seams are formed, the film must again be accelerated so that a new pouch can be made after the previous one has been formed and filled. Such film advances must be accomplished without unnecessarily stressing and unnecessarily distorting the interlocked profiles. It has been found that distortion can easily occur while the film is drawn around curves or bends in the formation.

One location where distortion has occurred is in the location where the film is shaped over forming shoulders while being fed onto the forming tube. With the interlocked profiles located between the edges of the film, it is necessary to draw the film over relatively sharp forming edges. If the profiles are drawn with tension over such forming edges, the longitudinal tensions caused lateral forces on the film which tend to open the groove of the interlocked film. The groove is formed with side legs and a sharp pull on the film will tend to spread the legs of the groove to cause a distortion in the size and shape of the groove. This causes an insecure interlock and an insecure holding of the rib so that the rib and groove loses its efficiency and effectiveness.

FEATURES OF THE INVENTION

An object of the present invention is to provide an improved form, fill and seal machine capable of continuously forming pouches or bags wherein the size and shape relationship of the rib and groove remain intact and the opportunities for the profiles to be damaged or distorted are substantially eliminated.

A still further object of the invention is to provide an improved forming machine for forming bags from a continuous supply of film having interlocked profiles thereon wherein damage caused by pulling the film in tension over edges in the mechanism are eliminated.

A still further object of the invention is to provide an arrangement wherein bags are made from a film having interlocked profiles thereon and a method and structure is provided for maintaining relaxing slack in the film particularly at the location of the profiles during the time when the film is drawn forwardly over forming surfaces and edges.

A further object of the invention is to provide an arrangement for feeding film to a vertical forming machine wherein the film has fastener profiles therein and the film can be fed with the fastener profiles offset from the center of the film without causing problems in feeding and bag forming such as by resultant skewing of the film. An object is to allow feeding film over a vertical forming machine wherein the vertical seam to be joined can be on the back side of the forming tube or offset from the center of the forming tube.

In accordance with the features of the invention, an endless supply of thin plastic film is supplied in sheet form with interlocked profiles intermediate the edges. The film material is fed up an inclined ramp over a relatively sharp bending or folding and shaping edge. A film feed is provided which maintains a tension preventing slack in the film so that the profiles are not pulled taut over the bending edge which shapes and forms the film. The film guiding control which maintains the slack is driven off the apparatus which advances the film over the forming tube. The structure is arranged so that the slack which is generated is prevented from becoming too great to disturb the formation and cause wrinkling in the film by slippage in the feed when the slack becomes too great.

Other advantages, features and objectives will become more clear with the teaching of the principles of the invention in connection with the disclosure of the preferred embodiments in the specification, claims and drawings, in which:

DESCRIPTION OF THE PREFERRED EMBODIMENTS

Figure 1:
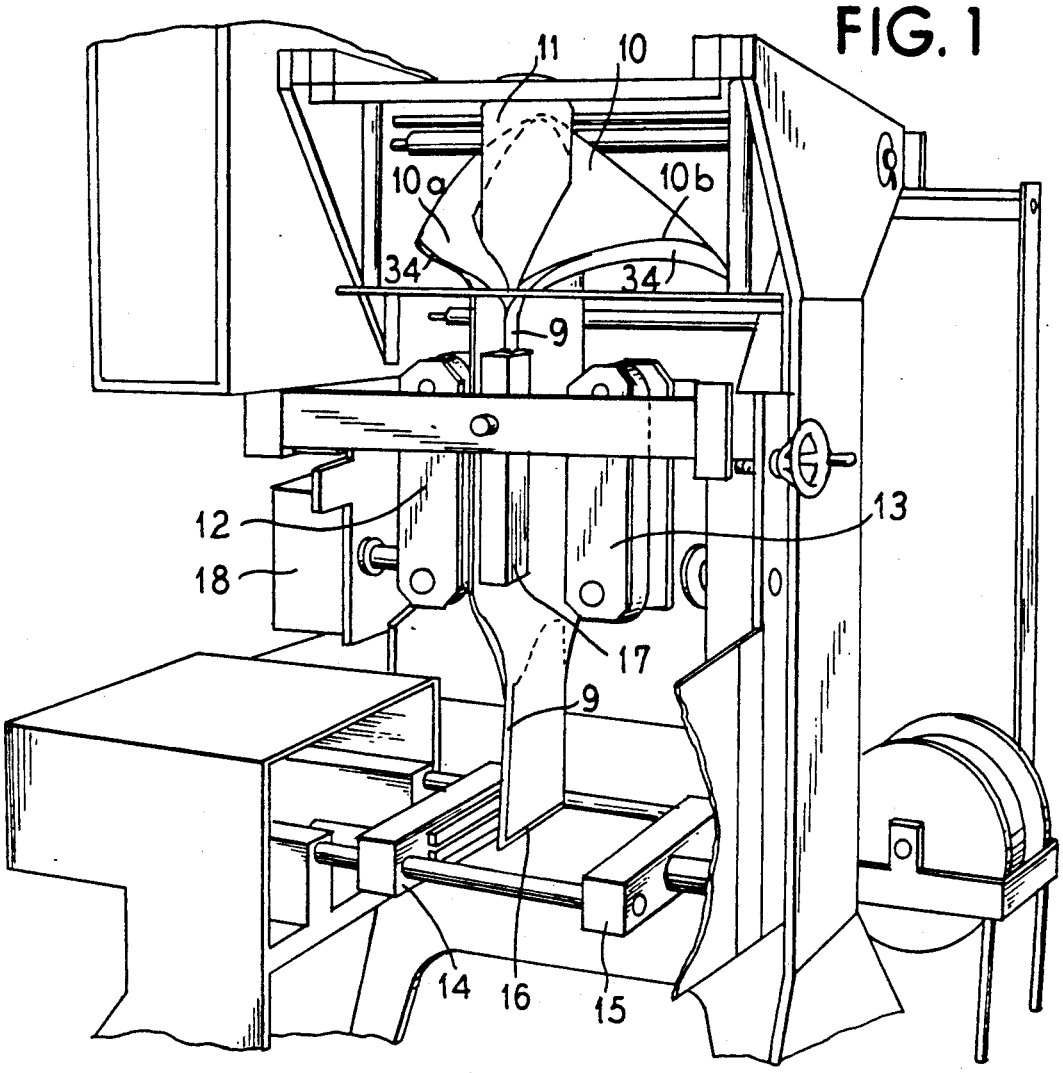
FIG. 1 is a perspective view of a forming and filling machine constructed and operating in accordance with the principles of the present invention.

FIG. 1 illustrates a continuous length of film 10 fed forwardly and downwardly over a forming tube 11. The forming tube is hollow and open at the top so that contents can be dropped therethrough into the tubular pouch which is formed from the film.

Film is drawn incrementally forwardly by suitable means such as drive belts 12 and 13 which engage the surface of the film at opposite sides of the forming tube 11. As an alternative, the film may be pulled downwardly by cross-seaming devices 14 and 15 which move together to clamp the film and form a seam 16 which seam forms a side seam on the bag. The film has rib and groove interlocked profiles on the side opposite the bottom seam 9 in the film. The bottom seam is formed by a seaming device 17 which heat seals the film edges **10*a* and 10*b* together. The belts for drawing the film incrementally downwardly over the tube 10 are driven by suitable mechanism 18** which is activated incrementally as the film is to be advanced by timing means for the machine.

Figure 2:
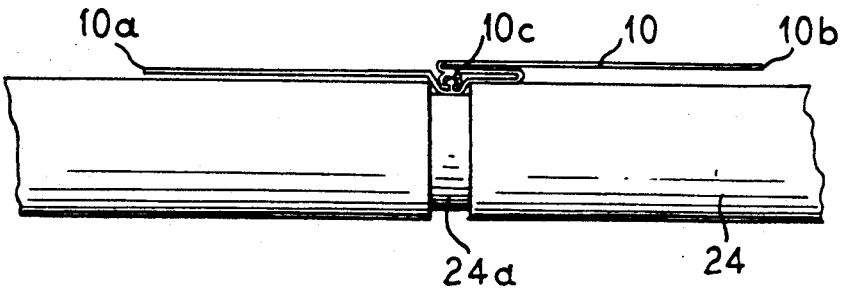
FIG. 2 is an enlarged sectional view taken substantially along line II—II of FIG. 4.
Figure 3:
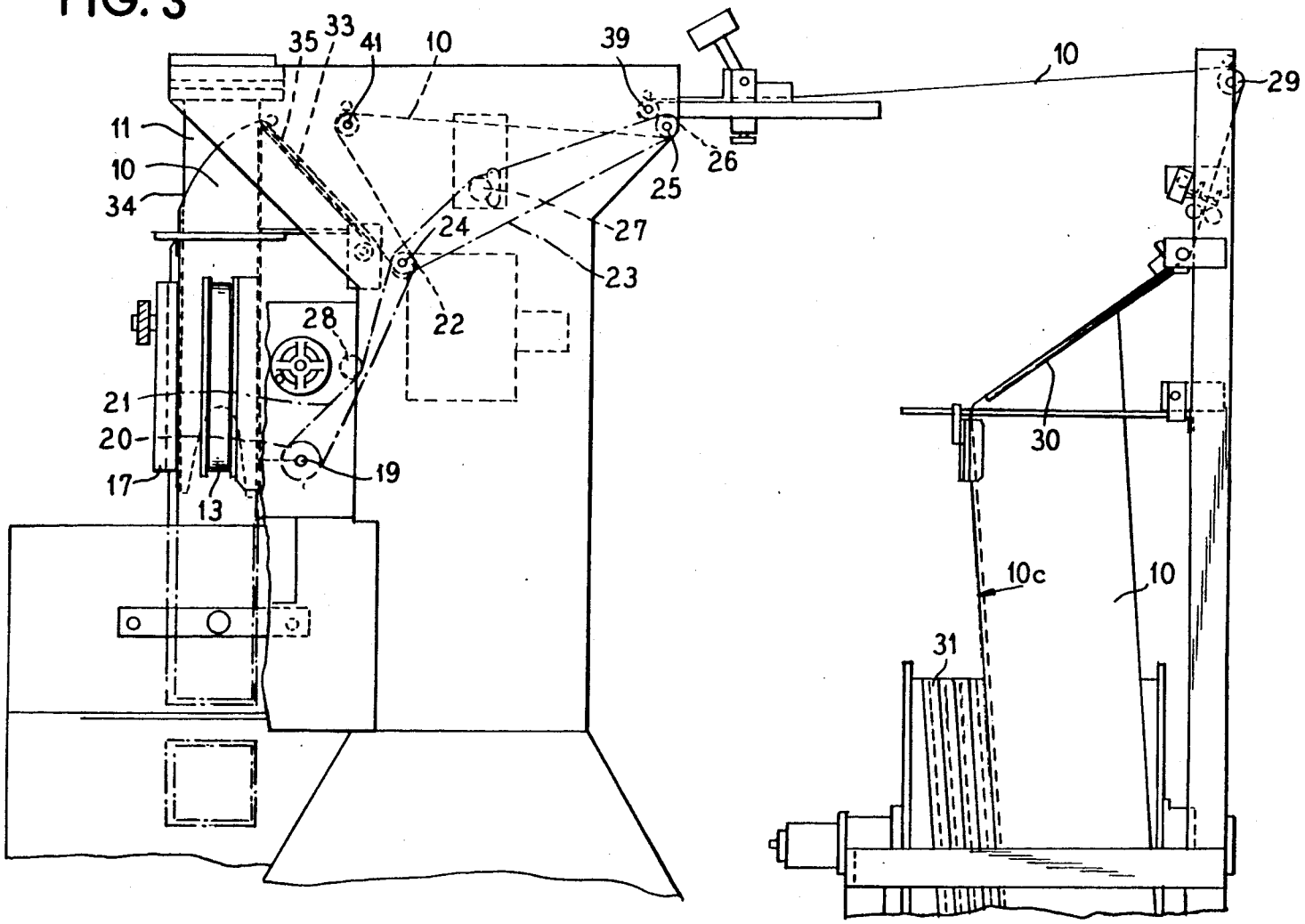
FIG. 3 is a side elevational view of the forming mechanism of FIG. 1 also illustrating the arrangement for feeding film to the machine.
Figure 4:
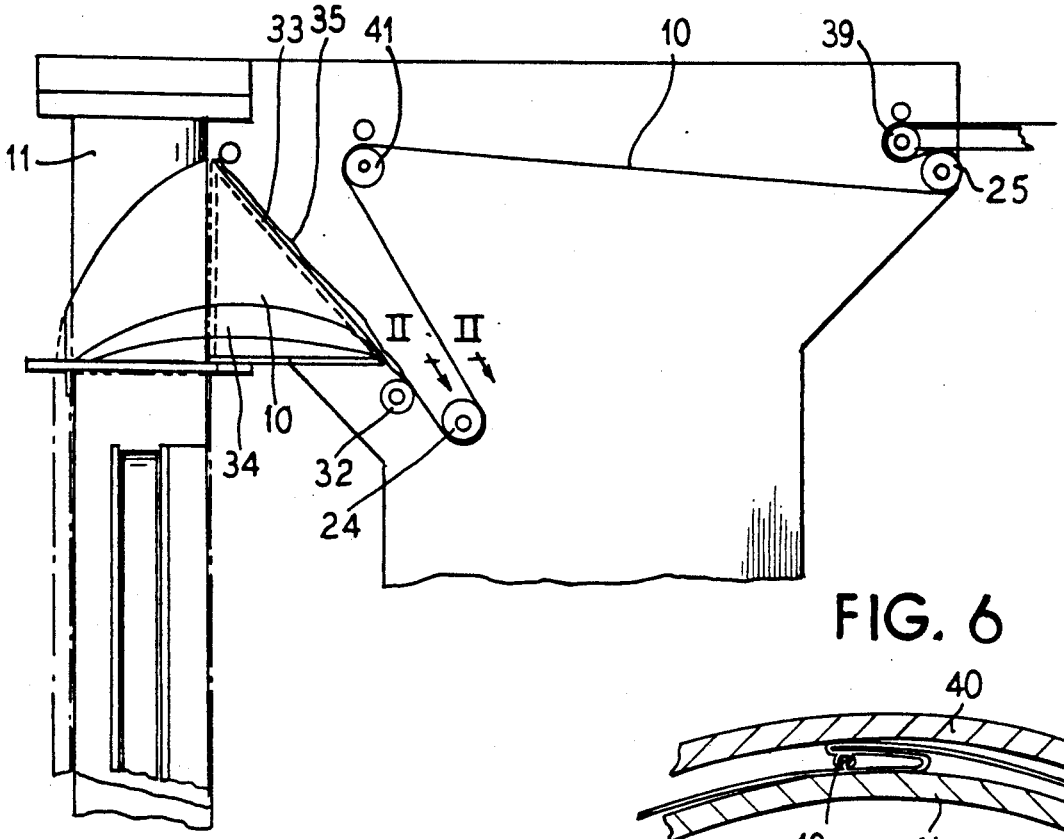
FIG. 4 is a fragmentary elevational view in somewhat schematic form showing a portion of the film feeding apparatus.

FIG. 3 illustrates the supply of thin plastic film for the machine. A supply of film is carried on a roll 31 with the film having been previously formed by extrusion with shaped interlocked profiles **10*c*, FIG. 2, between the film edges 10*a* and 10*b*. A guide roll 24, which will be described in greater detail later, carries the film just prior to it being received by the forming and filling machine, and the roll 24 has a groove 24*a* accommodating the additional bulk 10*c* of the profiles. The remainder of the film 10 rides on the surface of the roll 24 which controls the speed at which it is fed into the machine and the roll 24 is such that primarily it pushes the film to maintain non-tension slack in the film prior to it being fed over forming shoulders 34. If the slack becomes too great, the film slips on the surface of the guide and speed control roll 24**.

Returning the FIG. 3, the supply of film material is initially in doubled form with the profiles **10*c* at the edge. As the film is unwound from the roll 31, it is spread out in single layer form by spreaders 30. The film then passes upwardly over a guide roll 29 to be fed onto supply rolls 25 and 39. 39 maintains a wrap of the film over the roll 25**.

The film then passes over a supply and guide roll 41 which maintains a wrap of the film over the roll 24. As the film travels down over the guide roll 24, it ascends up a ramp 33 shown in greater detail in FIG. 5.

After the film ascends the ramp 33, the film edges **10*a* and 10*b* are shaped over curved shaping shoulders 34 which guide the edges onto the forming tube 11 to cause the film to wrap the tube. The film edges 10*a* and 10*b* then are drawn together to form the seam 9**.

Figure 6:
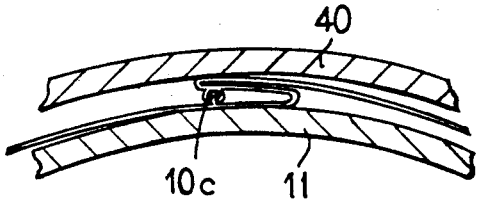
FIG. 6 is a fragmentary enlarged sectional view taken substantially along line VI—VI of FIG. 5.

In the center of the film, the interlocked rib and groove profiles **10*c* are turned downwardly at the top of the ramp 33 over an upper edge 36 of the ramp. The profiles of the film then pass downwardly between the outer surface of the tube 11 and a vertical guide plate 40 which is part of the ramp assembly. The profiles are loosely held between the tube 11 and the vertical plate 40 as illustrated in FIG. 6**.

In order to shape the film and form the tube, the film must be turned over an edge, such as shown at 36, causing a sharp turn 37 in the film at the location of the profiles. As the film is pulled downwardly by the belts 12 and 13, normally this will create a severe tension at the location of the profile **10*c*** causing the legs of the groove profile to spread and tending to damage the critical tolerance between the rib and groove of the interlocked profiles.

To avoid this sharp pull on the profiles which would be caused at the turn edge 36, a tension free slack 35 is formed in the web at the ramp which is located in a preshaping portion 35 of the web which is in advance of the forming shoulders 34. To maintain this tension free slack 35, the guide roll 24 drives the film so that the slack is maintained. An additional support roll 32 is located at the lead edge of the ramp to aid in stabilizing the film as it slides up the ramp.

To maintain the slack 35, a slack portion is first included in the film when the machine is loaded. In this manner if the guide roll 24 is driven at the speed of web advance, the slack will be retained. However, in one preferred form, the guide roll 24 is driven at a speed only slightly greater than the speed at which the film is pulled down over the forming tube 11.

The guide roll 24 is driven incrementally at the same time as when the belts 12 and 13 advance the web.

As shown in FIG. 3, the guide roll 24 is driven off of the same drive 18 as drives the belts, and a shaft 19 is driven by the drive 18 and carries a chain sprocket 20 thereon. The chain sprocket drives chain 21 which drives a sprocket 22 which in turn drives the guide roll 24. An idler roll 28 maintains the chain 21 under the proper tension. The sprocket 22 is a double sprocket driving a chain 23 which drives a sprocket 26 driving the supply roll 25. An idler tension roll 27 maintains the chain 23 at the proper tension. The supply roll 41 is driven at the same speed as the film advance belts 12 and 13 are driven. The guide roll 24, however, is arranged to be driven at a surface speed only slightly in excess of that of the surface speed of the pull down belts 12 and 13 and the supply roll 25.

Figure 5:
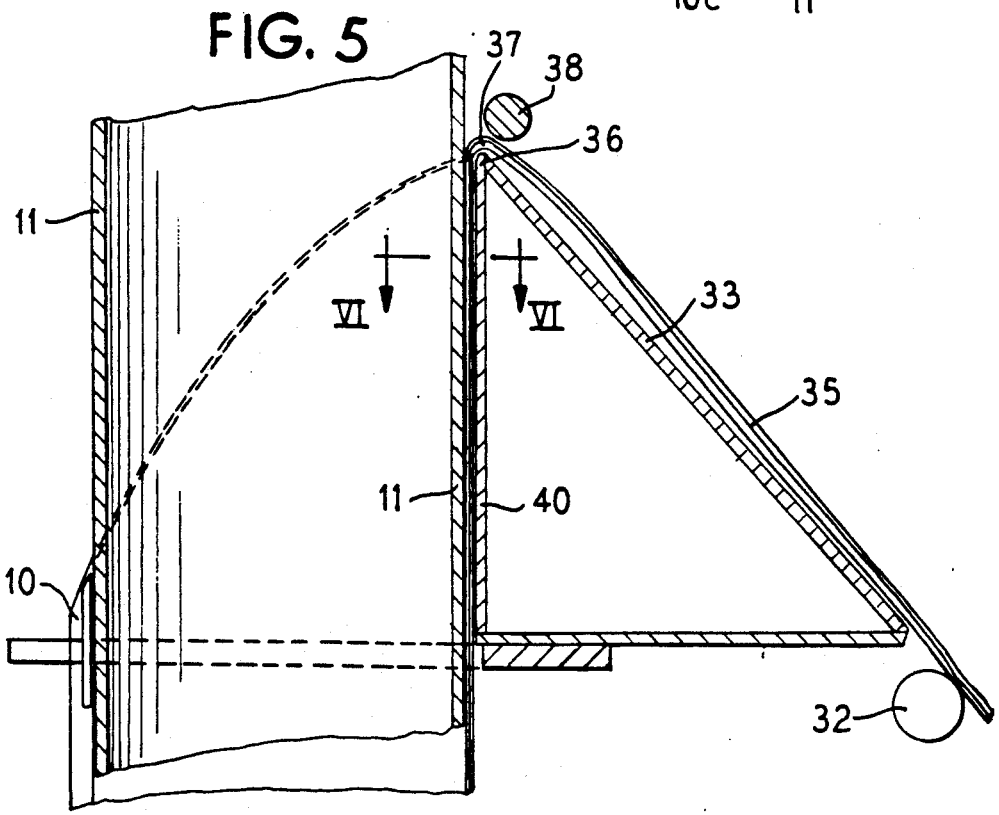
FIG. 5 is an enlarged vertical sectional view taken through the axis of the forming arrangement and generally showing a portion of the structure of FIG. 4.

As illustrated in FIG. 5, the roller 38 positioned above the shoulder 36, and the vertical guide strip 40 allow for uneven lengths of film to be pulled over the shoulder 36 without falling off to one side or without skewing. This allows a bag to be made wherein the seam at the edges of the film can be formed at one side of the forming tube 11. In other words, the film can be supplied with unequal widths of film at each side of the zipper. This allows the zipper to be located at any desired location on the face of the finished bag and the location of the zipper is not limited to being exactly at the top of the bag when the seam which joined the edges of the film is at the bottom. The fact that the machine must feed profile film requires more than just the shoulder 36 to turn the film. The vertical guide plate 40 is necessary to provide the vertical guiding surfaces for the film and profile.

Still referring to FIG. 5, the slack shown at 35 in the film allows the film to be more easily guided by the profiled zipper.

Figure 7:
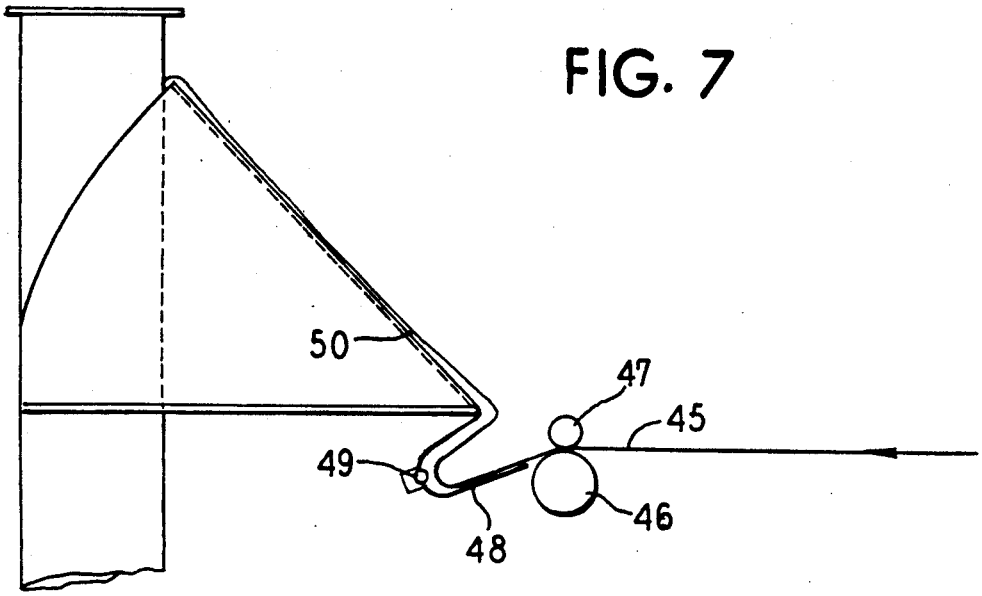
FIG. 7 is a fragmentary side elevational view shown in schematic form of another form of the invention for providing web slack in the feed.

FIG. 7 illustrates an alternate arrangement for controlling feed of the film. In FIG. 7, a layer of film is fed forwardly with a zipper integral in the film supply 45. The film web is pulled forwardly by a pinch roller drive including rollers 46 and 47. A bubble chute 48 is positioned at the base of an inclined ramp 50. A proximity switch 49 is located in the depth of the U-shaped bubble chute. The bubble chute allows for accumulation of the film web to insure web slack and zero friction at the forming shoulder and collar which are located at the top of the ramp. The proximity switch 49 controls the pinch roller drive and signals the web drive to increase or reduce the acceleration of the pinch roll drive for the film. Devices heretofore used have provided an accumulator or dancer arm located on the dispenser upstream from the web rollers. These prior devices do not minimize the friction at the shoulder collar to eliminate zipper damage and eventual malfunction of the zipper closure.

Figure 8:
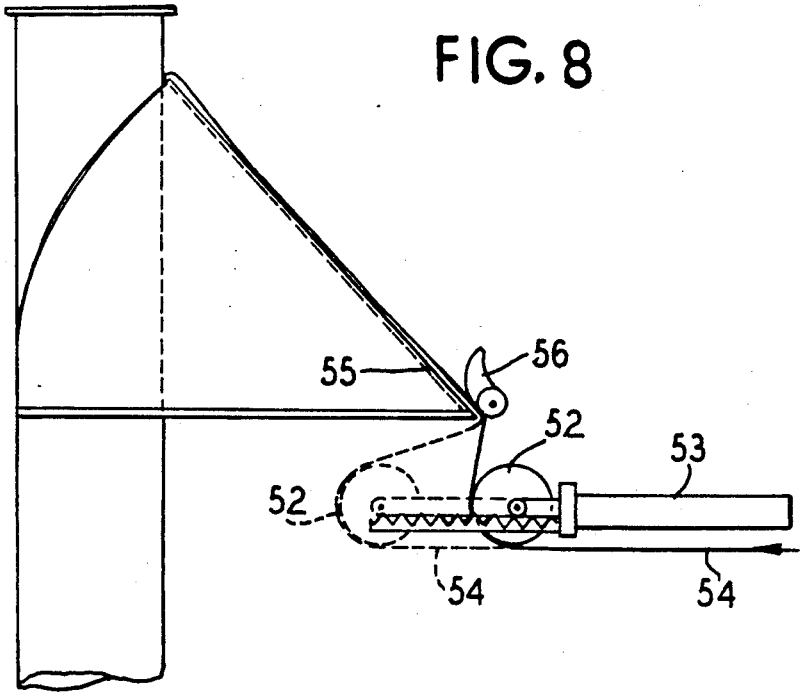
FIG. 8 is a fragmentary side elevational view shown in schematic form of another embodiment of the invention for producing slack in the web feed to the critical location to prevent damage to the zipper.

FIG. 8 illustrates another form of controlling the feed of a film web having a zipper profile therein. The film web 51 is fed forwardly and passes over a booster roller 52 which is movable laterally to control the size of a bubble 54 in the web. The position of the booster roll 52 is controlled by a reciprocating cylinder 53. The cylinder acts as a booster to pull a bag length of film from a dispenser supply roll during the rest cycle of the machine. The accumulated film forms the bubble 54 which provides minimum tension and friction when pulled over the shoulder during the bag feed cycle. The arrangement should include zipper guides in the roller 52. This arrangement eliminates the need for power dispensers and upstream zipper guides. It also eliminates zipper damage and zipper closure problems which occur if feeds of design structures heretofore available are used which provide severe bending and tension in the zipper passing over the forming shoulders. A pawl 56 is located at the base of the ramp 55. In operation during the time a bag is being filled and seamed, the booster roller 52 is moved to the left by the cylinder 53 to form the bubble loop 54. The roller 52 is then pulled back to the solid line position shown in FIG. 8. When a fresh length of web is pulled downwardly over the forming tube, the web is pulled against the slack formed by the bubble 54. The unidirectional pawl 56 prevents tension on the web when the booster roller 52 is moving to the left from the solid line to the dotted line position of FIG. 8.

In operation, this maintains the tension free slack 35. As this slack grows slightly, the film 10 will slip slightly on the roll 24. As soon as the slack at 35 tends to diminish, the film begins to tighten slightly around the guide roll 24 so that it maintains the slack 35. Thus, the roll 24 constitutes a feeding means for the film which continually operates to maintain a tension free slack at the preshaping portion of the web in advance of the forming tube 11. The ramp is a preferred arrangement for feeding the web to the forming shoulders 34, but it will be understood that the film can approach the forming shoulders at different angles. Regardless of the approach arrangement, a tension will occur causing the profiles to be bent over an edge or a surface. Not only will the profiles be bent, but an axial pull will be exerted to pull the profiles over an edge which has to be located at the entry to the forming shoulders.

In operation, axial stress and bending stress, both of which tend to distort the profiles, are avoided by maintaining the slack in advance of the forming shoulders.

Thus, it will be seen that I have provided an improved bag forming arrangement capable of making bags continuously from thin lightweight film which has critically shaped and sized interlocking profiles thereon. The arrangement meets the objectives and advantages set forth above and is capable of operating under circumstances of high speed production for continuous forming of bags and pouches from plastic film.

I CLAIM AS MY INVENTION:

1. A form, fill and seal machine for making reclosable zipper bags, comprising in combination:

means supplying an endless sheet of film with interlocked rib and groove profiles intermediate side edges of the film;

a forming and filling tube over which the sheet of plastic film is shaped for joining edges of the film to form a tubular container;

forming shoulders for guiding the endless sheet of film onto the tube bringing the film edges together;

and means feeding the film from the supplying means to said shoulders forming a tension free slack preshaping portion in the sheet in advance of said shoulders preventing profile distorting forces on the profile.

2. A form, fill and seal machine for making reclosable zipper bags constructed in accordance with claim 1:

and including an inclined ramp leading to said forming shoulders for supporting the tension free slack portion.

3. A form, fill and seal machine for making reclosable zipper bags constructed in accordance with claim 1:

including guide means sandwiching the profile portion as it passes onto the forming and filling tube.

4. A form, fill and seal machine for making reclosable zipper bags constructed in accordance with claim 1:
wherein said feeding means is a roll wrapped by the film.

5. A form, fill and seal machine for making reclosable zipper bags constructed in accordance with claim 4:
including a supply roll positioned ahead of the feeding roll to maintain a wrap over the feeding roll.

6. A form, fill and seal machine for making reclosable zipper bags constructed in accordance with claim 4:
including means for advancing the film over the tube;
and means connecting said advancing means drive to said roll for driving the roll at a greater speed than that which the film is advanced over the forming and filling tube.

7. A form, fill and seal machine for making reclosable zipper bags constructed in accordance with claim 1:
including a shoulder positioned between the feeding means and the tube over which the profiles are bent when the film passes onto the tube.

8. A form, fill and seal machine for making reclosable zipper bags constructed in accordance with claim 1:
wherein said film feeding means drives the film at a speed faster than the film is advanced over the forming and filling tube to maintain said tension free slack.

9. A form, fill and seal machine for making reclosable zipper bags constructed in accordance with claim 1:
wherein said film feeding means is a feeding roll over which the film is wrapped;
and wherein slippage occurs between the film and feeding roll when said tension free slack reaches a predetermined excessive amount.

10. A form, fill and seal machine for making reclosable zipper bags, comprising in combination:
a forming and filling tube over which a continuous web of plastic film having interlocking profiles is shaped for joining edges of the film to form a tubular container;
guide means for guiding the endless web of film onto the tube;
and means for maintaining a tension free slack in the film passing onto the guide means preventing distortion of the profiles.

11. A form, fill and seal machine for making reclosable zipper bags constructed in accordance with claim 10:
wherein the film is fed over a guide roll and slippage occurs between the guide roll and the film when the web slack exceeds a predetermined amount.

12. A method for making reclosable zipper bags on a form, fill and seal machine, comprising the steps:
drawing a web of plastic film forwardly over a forming and filling tube for joining edges of a film having interlocking profiles for a tubular container;
guiding the film over forming shoulders onto the tube;
and maintaining a tension free slack preshaping portion in the web in advance of the forming shoulders for preventing distortion of the profiles.

13. A method for making reclosable zipper bags on a form, fill and seal machine in accordance with the steps of claim 12:
including wrapping the film over a guiding roller in advance of the forming shoulders;
and causing slippage over the guide roll when the web slack becomes too great.

14. A method for making reclosable zipper bags on a form, fill and seal machine in accordance with the steps of claim 12:
including feeding the film over an ascending ramp to the forming shoulders;
and positioning a guide roller at the base of the ramp feeding the film at a speed slightly greater than the feed over the forming tube to maintain the slack in the web.

15. A form, fill and seal machine for making reclosable zipper bags, comprising in combination:
a vertical forming and filling tube over which a web of plastic film is shaped having interlocking rib and groove profiles intermediate side edges of the film;
means for joining the edges of the film to form a tubular container;
forming shoulders at the upper ends of the tube for guiding an endless supply of film onto the tube bringing the film edges together over the tube;
an inclined ramp leading to the forming shoulders over which the web and profiles are drawn;
a feed supply roller for feeding an endless supply of film to the tube;
a guide roller positioned at the base of the ramp with the film partially wrapped around the guide roller, said guide roller frictionally driving the web when the web is wrapped at a predetermined minimum tension;
and means driving the guide roller at a feed speed slightly greater than movement of the film over the tube to cause a tension free web slack on the ramp, the web slipping on the guide roller when the slack increases beyond a predetermined amount and the web wrap over the guide roller falls below the minimum tension.

16. A form, fill and seal machine for making reclosable zipper bags, comprising in combination:
means supplying an endless sheet of film with interlocked rib and groove profiles intermediate side edges of the film;
a forming and filling tube over which the sheet of plastic film is shaped for joining edges of the film to form a tubular container;
forming shoulders for guiding the sheet of film onto the tube bringing the film edges together;
means feeding the film from the supplying means;
and means forming a tension-free bubble loop in the film between the supplying means and the forming shoulders.

17. A form, fill and seal machine for making reclosable zipper bags constructed in accordance with claim 16:
including film proximity detecting means for detecting the position of the loop.

18. A form, fill and seal machine for making reclosable zipper bags constructed in accordance with claim 16:
including a reciprocating means carrying the film forwardly to form the bubble intermediate advancement of the film over the forming tube.

19. A form, fill and seal machine for making reclosable zipper bags constructed in accordance with claim 16:
wherein the loop is formed by a reciprocating roller.

20. A method for making reclosable zipper bags on a form, fill and seal machine comprising the steps:

drawing a web of plastic film forwardly over a forming and filling tube for joining edges of the film to make a tubular container;

guiding the film over forming shoulders onto the tube;

and forming a tension-free bubble loop in the film in advance of the forming shoulders.

21. A method of making reclosable zipper bags on a form, fill and seal machine in accordance with the steps of claim 20:

including forming the loop intermediate incremental advances of the film over the forming tube.

22. A method of making reclosable zipper bags on a form, fill and seal machine in accordance with the steps of claim 20:

including sensing the size of the loop and feeding the web forwardly to obtain a loop of a predetermined size.

* * * * *